US010030572B2

(12) United States Patent
Chekaiban et al.

(10) Patent No.: US 10,030,572 B2
(45) Date of Patent: Jul. 24, 2018

(54) COOLANT CIRCUIT FOR AN INTERNAL COMBUSTION ENGINE

(71) Applicant: Bayerische Motoren Werke Aktiengesellschaft, Munich (DE)

(72) Inventors: Georg Chekaiban, Wolnzach (DE); Rainer Richter, Munich (DE); Andreas Klemm, Munich (DE); Ulrich Wirth, Munich (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 189 days.

(21) Appl. No.: 14/737,872

(22) Filed: Jun. 12, 2015

(65) Prior Publication Data

US 2015/0275742 A1 Oct. 1, 2015

Related U.S. Application Data

(63) Continuation of application No. PCT/EP2013/073850, filed on Nov. 14, 2013.

(30) Foreign Application Priority Data

Dec. 13, 2012 (DE) ..... 10 2012 223 069

(51) Int. Cl.
*F01P 7/14* (2006.01)
*F01P 7/16* (2006.01)
(Continued)

(52) U.S. Cl.
CPC ..... *F01P 7/165* (2013.01); *F01P 3/20* (2013.01); *F01P 7/164* (2013.01);
(Continued)

(58) Field of Classification Search
CPC ..... F01P 2005/105; F01P 2005/125; F01P 2060/02; F01P 2060/14; F01P 3/20; F01P 7/164; F01P 7/165; F02B 29/0437
(Continued)

(56) References Cited

U.S. PATENT DOCUMENTS 3,439,657 A * 4/1969 Gratzmuller ..... F01P 3/20 123/41.31
4,236,492 A * 12/1980 Tholen ..... F01P 3/18 123/563
(Continued)

FOREIGN PATENT DOCUMENTS

DE 41 04 093 A1 8/1992
DE 102 28 355 A1 1/2004
(Continued)

OTHER PUBLICATIONS

FR 2846368 English Translation.*
(Continued)

*Primary Examiner* — Marguerite McMahon
*Assistant Examiner* — Tea Holbrook
(74) *Attorney, Agent, or Firm* — Crowell & Moring LLP

(57) ABSTRACT

A coolant circuit is provided for an internal combustion engine having a compression machine for intake air. The coolant circuit includes a high-temperature circuit and a low temperature circuit. The high-temperature circuit is provided in order to cool the internal combustion engine by way of a coolant radiator and a first coolant pump arranged in the high-temperature circuit. The low-temperature circuit is provided with a second coolant pump in order to cool the intake air compressed by the compression machine by way of an intercooler and in order to cool a coolant of a coolant circuit in a condenser. The high-temperature circuit and the low-temperature circuit are cooling circuits which are sepa-
(Continued)

rated from each other. The thermal base load of the low-temperature circuit is reduced by this design, whereby the pressure level in the coolant circuit can be reduced resulting positively in a reduction of the energy consumption.

16 Claims, 1 Drawing Sheet

(51) Int. Cl.
*F01P 3/20* (2006.01)
*F02B 29/04* (2006.01)
*F01P 5/10* (2006.01)
*F01P 5/12* (2006.01)

(52) U.S. Cl.
CPC ... *F01P 2005/105* (2013.01); *F01P 2005/125* (2013.01); *F01P 2060/02* (2013.01); *F01P 2060/14* (2013.01); *F02B 29/0437* (2013.01)

(58) Field of Classification Search
USPC ..... 123/41.01
See application file for complete search history.

(56) References Cited

U.S. PATENT DOCUMENTS 4,381,736 A * 5/1983 Hirayama ..... F01P 7/164 123/41.1
4,385,594 A * 5/1983 Hauser, Jr. ..... F01P 3/20 123/41.29
4,870,833 A * 10/1989 Matsuda ..... B60H 1/00428 62/134
5,215,044 A 6/1993 Banzhaf et al.
5,333,677 A * 8/1994 Molivadas ..... F03G 6/003 123/41.21
5,353,757 A 10/1994 Susa et al.
5,394,854 A * 3/1995 Edmaier ..... F01P 7/165 123/542
7,047,913 B2 * 5/2006 Werner ..... F02B 29/0443 123/41.29
8,555,826 B2 * 10/2013 Feldhaus ..... F01P 3/20 123/41.02
9,596,786 B2 * 3/2017 Ding ..... H01L 23/473
2001/0045103 A1 * 11/2001 Khelifa ..... B60H 1/143 62/244
2004/0050543 A1 * 3/2004 Kim ..... F01P 3/18 165/202
2004/0200220 A1 * 10/2004 Shakenis ..... F02B 29/0493 60/599
2005/0000473 A1 * 1/2005 Ap ..... F01P 7/165 123/41.1
2007/0000457 A1 * 1/2007 Guerrero ..... B60H 1/3227 123/41.31
2007/0101730 A1 * 5/2007 Chen ..... F25D 21/04 62/6
2009/0151659 A1 * 6/2009 Dolker ..... F02B 29/0493 123/41.09
2010/0126438 A1 * 5/2010 Kim ..... B60K 6/32 123/41.21
2011/0132030 A1 * 6/2011 Kim ..... B60H 1/00885 62/507
2011/0214627 A1 * 9/2011 Nishikawa ..... F01P 7/04 123/41.02
2013/0255296 A1 * 10/2013 Kardos ..... B60H 1/3205 62/126
2013/0333640 A1 * 12/2013 Kardos ..... F02B 29/0443 123/41.1

FOREIGN PATENT DOCUMENTS

DE 10 2007 018 428 A1 10/2008
DE 10 2007 060 670 B4 11/2009
DE 10 2010 015 331 A1 12/2010
DE 10 2010 039 810 A1 3/2012
EP 0 909 932 A2 4/1999
EP 2 423 482 A2 2/2012
FR 2 846 368 A1 4/2004
FR 2846368 B1 * 2/2007 ..... F01P 7/165
WO WO 03/042515 A1 5/2003
WO WO 2006/070080 A1 7/2006

OTHER PUBLICATIONS

International Search Report (PCT/ISA/210) dated Feb. 12, 2014, with English translation (seven (7) pages).
German-language Written Opinion (PCT/ISA/237) dated Feb. 12, 2014 (five (5) pages).
German Search Report dated Jul. 26, 2013, with partial English translation (ten (10) pages).

* cited by examiner

COOLANT CIRCUIT FOR AN INTERNAL COMBUSTION ENGINE

CROSS REFERENCE TO RELATED APPLICATIONS

This application is a continuation of PCT International Application No. PCT/EP2013/073850, filed Nov. 14, 2013, which claims priority under 35 U.S.C. § 119 from German Patent Application No. 10 2012 223 069.6, filed Dec. 13, 2012, the entire disclosures of which are herein expressly incorporated by reference.

BACKGROUND AND SUMMARY OF THE INVENTION

The invention relates to a coolant circuit for an internal combustion engine comprising a compression machine for intake air, with the coolant circuit consisting of a high-temperature circuit and a low-temperature circuit, and with the high-temperature circuit being provided to cool the internal combustion engine by way of a coolant radiator and a first coolant pump arranged in the high-temperature circuit.

German unexamined patent application DE 41 04 093 A1 discloses a cooling system for vehicles with internal combustion engines, which includes a plurality of coolant circuits with associated heat exchangers that are designated as follows: the first heat exchanger cools the engine coolant, the second cools the engine lubricant, and the third cools the charge air. Temperature sensors are arranged in each coolant circuit and are connected to an electrical switching device. The switching device is connected to actuating elements that control the performance of the heat exchangers as a function of the signals from the temperature sensors. The cooling system is characterized in that a first control unit is provided which includes at least one microprocessor and determines the required cooling energy demand of the individual coolant circuits as a function of the signals from the temperature sensors, and in that actuating elements are assigned to each of the coolant circuits to individually influence the performance of the respective heat exchanger.

The known prior art has the disadvantage that parasitic heat flow from the engine compartment of the vehicle and from an exhaust turbocharger heats up the low-temperature circuit even under low load conditions. This results in an excessive temperature level in each temperature circuit. The result is excessive energy consumption, including in the air conditioning system that controls the temperature in a passenger compartment.

The object of the present invention is to provide a measure to avoid the afore-mentioned disadvantages.

This and other objects are achieved according to the invention by providing a completely separate low-temperature circuit from the high-temperature circuit, with the intercooler and the condenser being arranged in the low-temperature circuit.

This results in a complete separation of the high-temperature circuit for the coolant that cools the internal combustion engine from the low-temperature circuit that indirectly cools the charge air and air conditions a passenger compartment.

According to a further development of the invention, the intercooler and the condenser are preferably arranged in parallel in the low-temperature circuit, e.g. the coolant flows in parallel through both.

Further, a first valve is arranged upstream of the intercooler in the direction of flow of a coolant, and/or a second valve is located upstream of the condenser. This results in several advantageous synergy effects, which is shown in a table below. In a further example of an embodiment, the valves may also be located downstream of the intercooler and/or the condenser, or an intermix of said arrangements.

Preferably, the valves are operated in a regulated or controlled fashion.

Furthermore, the second coolant pump is preferably operated at a speed that meets the operating conditions so as to ensure optimal efficiency.

With the coolant circuit according to the invention for an internal combustion engine, the following operating situations can then be described advantageously as a function of the operating condition of the internal combustion engine (ICE):

| Operating point of the ICE: | Second coolant pump: | First valve: | Second valve: | Comment: |
|---|---|---|---|---|
| e.g.: at idle | controlled by demand | closed | open | High demand for air conditioning at idle, for example during stop-and-go traffic at high outside air temperature. In this case, increase of the coolant flow over the condenser, and reduction of the cooling of the charge air, or valve timing, if applicable. |
| e.g.: Max. load on a restricted access highway [Autobahn] | controlled by demand | open | closed | High demand on charge air cooling with simultaneously low air conditioning demand, such as during moderate outside temperatures and high demand driving (e.g. restricted access highway, dynamic mountain driving) |
| Max. air conditioning and max. load of internal combustion engine | controlled by demand | open | open | High demand driving resulting in high cooling need of the intercooler. Simultaneously high outside air temperature and high air conditioning demand. |

Due to the design of the cooling circuit according to the invention, parasitic heat intake is reduced and, therefore, the thermal base load of the low-temperature cooling circuit is reduced. This leads to a reduction of the pressure level in the refrigeration cycle, which results in a positive reduction of the total energy consumption.

Other objects, advantages and novel features of the present invention will become apparent from the following detailed description of one or more preferred embodiments when considered in conjunction with the accompanying drawing.

DETAILED DESCRIPTION OF THE DRAWING

Figure 1:
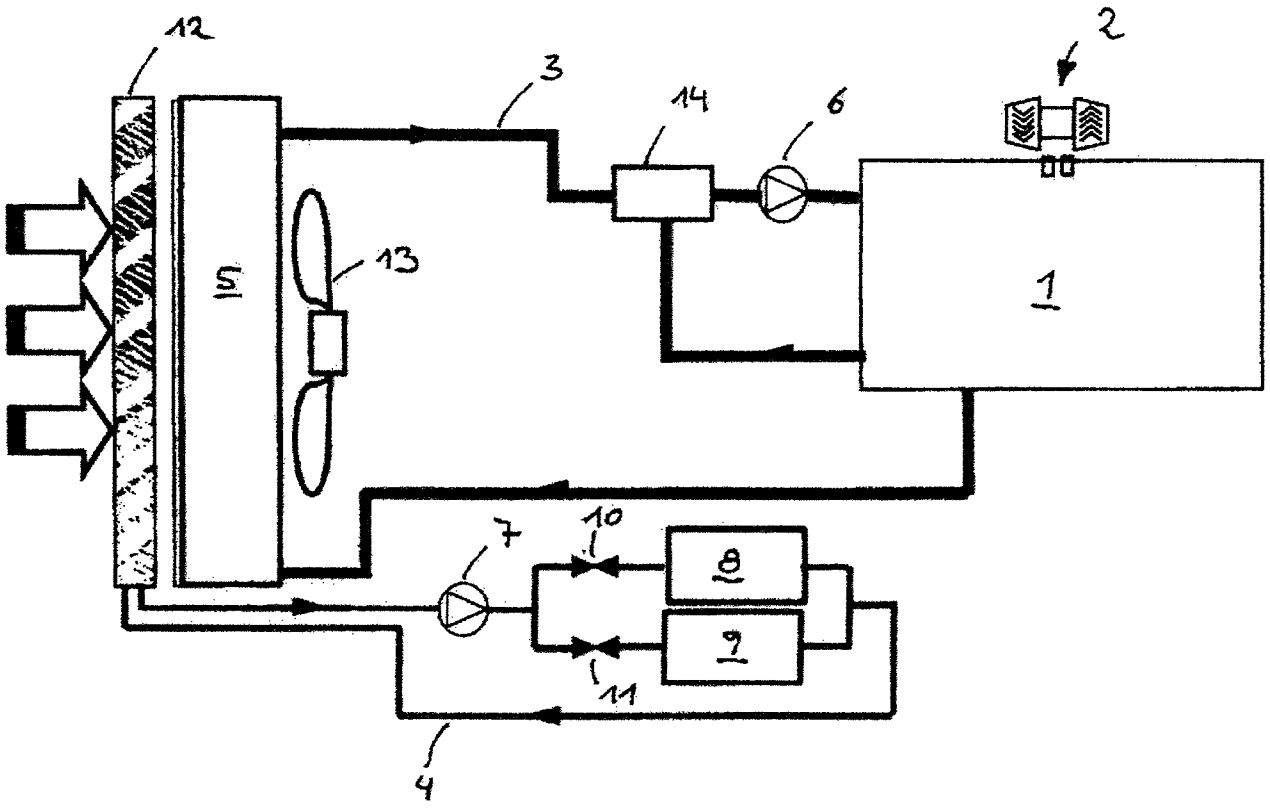
FIG. 1 is a block diagram of a cooling circuit according to an embodiment of the invention for an internal combustion engine

FIG. 1 shows a block diagram of a cooling circuit according to an embodiment of the invention for an internal combustion engine 1 with a compression machine 2; the present exemplary embodiment shows a compressor of an exhaust turbocharger to compress intake air for the internal combustion engine. It goes without saying that this can also be a mechanical charger.

The entire coolant circuit consists of a high-temperature circuit 3 and a low-temperature circuit 4.

In the high-temperature circuit 3, a coolant radiator 5 is provided to cool the internal combustion engine 1, and a first coolant pump 6 is provided, which is arranged in the high-temperature circuit 3. The intake temperature into the internal combustion engine can be regulated and/or controlled with the help of a thermostatic valve 14. A direction of flow of the coolant is shown schematically in FIG. 1 by way of arrows. Furthermore, a fan 13 is provided to improve the cooling efficiency of the coolant radiator 5.

Furthermore, the low-temperature circuit 4 includes a second coolant pump 7 as well as a second coolant radiator 12 to cool the intake air that has been compressed by the compression machine 2 by way of an intercooler 8. Additionally, the low-temperature circuit 4 includes a condenser 9 to cool a refrigerant of a refrigeration cycle for air conditioning of the passenger compartment.

According to the invention, the high-temperature circuit 3 and the low-temperature circuit 4 are separate circuits. Furthermore, the intercooler 8 and the condenser 9 are arranged in parallel to one another in the low-temperature circuit 4, e.g. the coolant flows through both of them in parallel. In the present embodiment, a first valve 10 is provided in the low-temperature circuit 4 upstream of the intercooler 8 in the direction of flow of the coolant, and a second valve 11 is provided upstream of the condenser 9. In a further embodiment, the valves 10 and 11 may also be arranged downstream of the condenser 9 or the intercooler 8, or they may be arranged in an intermixed order. Preferably, the valves 10 and 11 can be operated in a regulated or controlled manner by an electronic control unit (not shown), such as a motor control device, for example.

Furthermore, the speed of second coolant pump 7 can also be operated via the electronic control unit according to the demand on the system, which means that a high cooling demand sets a high speed and a low cooling demand sets a low speed for the second coolant pump 7. The second coolant pump 7 could be an electrically operated coolant pump, for example.

In the present embodiment, the second coolant radiator 12 is arranged upstream of the coolant radiator 5 with respect to the air flow direction, which is represented schematically by three wide arrows In other embodiments, the coolant radiators may also be arranged to partially overlap, or to be arranged side by side.

With the coolant circuit according to the invention for an internal combustion engine 1, the following operating situations can then be advantageously represented as a function of the operating condition of the internal combustion engine 1:

| Operating point of the ICE: | Second coolant pump: | First valve: | Second valve: | Comment: |
|---|---|---|---|---|
| e.g.: at idle | Controlled by demand | closed | open | High demand for air conditioning at idle, for example during stop-and-go traffic at high outside air temperature. In this case, increase of the coolant flow over the condenser, and reduction of the cooling of the charge air, or valve timing, if applicable. |
| e.g.: Max. power on a restricted access highway [Autobahn] | Controlled by demand | open | closed | High demand on charge air cooling with simultaneously low air conditioning demand, such as during moderate outside temperatures and high demand driving (e.g. restricted access highway, dynamic mountain driving) |
| Max. air conditioning and max. power of internal combustion engine | Controlled by demand | open | open | High demand driving resulting in high cooling demand of the intercooler. Simultaneously high outside air temperature and high air conditioning demand. |

Due to the design of the cooling circuit according to the invention, parasitic heat intake is reduced, and therefore the thermal base load of the low-temperature cooling circuit is reduced. This leads to a reduction of the pressure level in the refrigeration cycle, which results in a positive reduction of the total energy consumption.

LIST OF REFERENCE SYMBOLS

1. Internal combustion engine
2. Compression machine
3. High-temperature circuit
4. Low-temperature circuit
5. Coolant radiator
6. First coolant pump
7. Second coolant pump
8. Intercooler
9. Condenser
10. First valve
11. Second valve
12. Second coolant radiator
13. Fan
14. Thermostatic valve The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A coolant circuit for an internal combustion engine having a compression machine for intake air, the coolant circuit comprising:

a high-temperature circuit;

a low-temperature circuit; and a controller, wherein the high-temperature circuit is configured to cool, using a first coolant, the internal combustion engine via a first coolant radiator and a first coolant pump arranged in the high-temperature circuit, the low-temperature circuit comprises:

a second coolant pump;

a second coolant radiator;

a first valve disposed upstream or downstream of an intercooler; and a second valve disposed upstream or downstream of a condenser, wherein the controller is configured to control opening or closing of the first and second valves differently between an idling operation of the engine and a driving operation of the engine to cool, using a second coolant separate from the first coolant, air compressed by the compression machine via the intercooler and to cool, using the second coolant, a refrigerant of a refrigeration cycle in the condenser, and the high-temperature circuit and the low-temperature circuit are cooling circuits that are completely separated from each other.

2. The coolant circuit according to claim 1, wherein the intercooler and the condenser are arranged in parallel to one another in the low-temperature circuit.

3. The coolant circuit according to claim 2, wherein the first valve is arranged upstream of the intercooler relative to a flow direction of the second coolant.

4. The coolant circuit according to claim 3, wherein the second valve is arranged upstream of the condenser relative to a flow direction of the second coolant.

5. The coolant circuit according to claim 4, wherein the first and second valves are controlled based on a demand for air conditioning and/or a load demand on the engine.

6. The coolant circuit according to claim 4, wherein the first and second valves are controlled such that the first valve is closed while the second valve is open during idling of the engine.

7. The coolant circuit according to claim 3, wherein the second coolant pump is configured to operate at a speed tailored to demand.

8. The coolant circuit according to claim 2, wherein the second valve is arranged upstream of the condenser relative to a flow direction of the second coolant.

9. The coolant circuit according to claim 2, wherein the second coolant pump is configured to operate at a speed tailored to demand.

10. The coolant circuit according to claim 2, wherein the second coolant flows through both the intercooler and the condenser.

11. The coolant circuit according to claim 2, wherein the first and second valves are controlled based on a demand for air conditioning and/or a load demand on the engine.

12. The coolant circuit according to claim 1, wherein the first valve is arranged upstream of the intercooler relative to a flow direction of the second coolant.

13. The coolant circuit according to claim 1, wherein the second valve is arranged upstream of the condenser relative to a flow direction of the second coolant.

14. The coolant circuit according to claim 13, wherein the second coolant pump is configured to operate at a speed tailored to demand.

15. The coolant circuit according to claim 1, wherein the second coolant pump is configured to operate at a speed tailored to demand.

16. The coolant circuit according to claim 1, wherein the low-temperature circuit indirectly cools the air compressed by the compression machine using the second coolant.

* * * * *